US005865200A

United States Patent [19]

Kuang et al.

[11] Patent Number: 5,865,200

[45] Date of Patent: Feb. 2, 1999

[54] COLLAPSIBLE UMBRELLA WITH A RELIABLE AND SMOOTH SELF-OPENING MECHANISM

[75] Inventors: Lin Chung Kuang; Jung Jen Chang, both of Taipei Hsien, Taiwan

[73] Assignee: Fu Tai Umbrella Works, Ltd., Taipei Hsien, Taiwan

[21] Appl. No.: 10,615

[22] Filed: Jan. 22, 1998

[30] Foreign Application Priority Data

Nov. 7, 1997 [TW] Taiwan ..... 86218693

[51] Int. Cl.[6] ..... A45B 25/00

[52] U.S. Cl. ..... 135/29; 135/31

[58] Field of Search ..... 135/29, 31, 32, 135/22, 24, 25.1, 25.3, 25.31, 25.32

[56] References Cited

U.S. PATENT DOCUMENTS

| | | | |
|---|---|---|---|
| 3,672,381 | 6/1972 | Kida et al. | 135/22 |
| 4,030,515 | 6/1977 | Weber | 135/32 X |
| 4,986,294 | 1/1991 | Wu | 135/29 X |
| 5,392,799 | 2/1995 | Lai | 135/31 X |
| 5,492,140 | 2/1996 | Lin et al. | 135/24 |
| 5,551,463 | 9/1996 | Wang | 135/31 X |

*Primary Examiner*—Lanna Mai
*Attorney, Agent, or Firm*—Ezra Sutton

[57] ABSTRACT

A collapsible umbrella with a self-opening mechanism is provided. The collapsible umbrella includes a stretchable multi-segment shaft having a top end and a bottom end; an upper fixed hub mounted axially on the top end of the shaft, the upper fixed hub being formed with a plurality of alignment slots and a threaded hole, the threaded hole allowing a finishing cap of either an inner-threaded type or an outer-threaded type to be mounted thereon; a running hub slidably mounted on the shaft; a collapsible frame of a plurality of ribs including a set of upper ribs, a set of inner branch ribs, a set of middle branch ribs, a set of linkage ribs, and a set of outer branch ribs, wherein each of the middle branch ribs is formed with a substantially U-shaped cross section to form a slot and integrally formed with a retaining piece; a fabric held on the collapsible frame; and elastic means which allows the collapsed umbrella to be thereafter expanded in a self-opening manner. The foregoing collapsible umbrella allows a more secured and reliable self-opening mechanism for the umbrella. Moreover, it allows either an inner-threaded type or an outer-threaded type of finishing cap to be mounted on the upper fixed hub of the umbrella for versatile utilization.

5 Claims, 7 Drawing Sheets

COLLAPSIBLE UMBRELLA WITH A RELIABLE AND SMOOTH SELF-OPENING MECHANISM

BACKGROUND OF THE INVENTION

1. Field of the Invention

This invention relates to umbrellas, and more particularly, to a collapsible umbrella (also called folding umbrella) with a reliable and smooth self-opening mechanism.

2. Description of Related Art

A collapsible umbrella is typically composed of a stretchable multi-segment shaft, an upper fixed hub mounted on the top end of the shaft, a running hub slidably mounted on the shaft which can move along the shaft in either directions to open or collapse the umbrella, a collapsible frame of radiating ribs which are linked to the upper fixed hub and the running hub, and a fabric held on the collapsible frame to serve as a cover against rain or shine. Moreover, a finishing cap is mounted on the top of the upper fixed hub. In the umbrella industry, however, there are two standards for the mounting of the finishing cap on the upper fixed hub: one is the outer-threaded type (USA standard) which is formed with a threaded bolt that can be screwed into a threaded hole formed in the upper fixed hub; and the other is the inner-threaded type (Japanese standard) which is formed with a threaded hole that allows a threaded bolt formed on the upper fixed hub to be screwed thereinto. Apparently, these two standards are incompatible. Therefore, the umbrella manufacturers have to provide two different types of finishing caps and upper fixed hubs to meet the different standards in different countries, which considerably increase the difficulty in manufacture as well as in inventory management, and thus the manufacturing cost is high.

Further, as shown in FIG. 15, to help the self-opening operation of the collapsed umbrella to be more smooth, an assembly of an elastic piece and a coil spring is customarily mounted on each pair of an inner branch rib and a middle branch rib of the collapsible frame. The elastic piece is a bent wire having one end (the bent portion) linked to the inner branch rib and the other end (the two tips) inserted in the coil spring. Further, the coil spring is mounted in a groove formed from a U-shaped section of the middle branch rib, which is secured firmly in position by forcibly narrowing the portion of the U-shaped section of the middle branch rib where the coil spring is mounted. This method of firmly securing the coil spring in position, however, requires high precision to perform in order to reliably secure the coil spring in position without fear of being self dismounted due to poor machining or after a long period of use. This requirement can, however, considerably increase the manufacturing cost of the umbrella. Moreover, after a long period of repetitive uses, the securing means for the coil spring can be deformed such that it can no long secure the coil spring firmly in position, causing the coil spring to be likely to fall off the middle branch rib. Should this be the case, the self-opening mechanism of the collapsible umbrella will fail, and the user has to open the umbrella manually.

Still another drawback of the conventional collapsible umbrellas is that the upper fixed hub is customarily formed with a polygonal shape, which can somewhat cause the collapsing and opening of the collapsible frame to be unsmooth. The use of the collapsible umbrella is thus inconvenient.

SUMMARY OF THE INVENTION

It is therefore an objective of the present invention to provide a collapsible umbrella, which can be used in conjunction with either an outer threaded type or an inner threaded type of finishing cap.

It is another an objective of the present invention to provide a collapsible umbrella, which allows a secured and reliable self-opening mechanism for the umbrella that be can operate smoothly.

It is still another objective of the present invention to provide a collapsible umbrella, which can allow a reduced cost to manufacture.

In accordance with the foregoing and other objectives of the present invention, a collapsible umbrella is provided.

The collapsible umbrella of the invention includes the following constituent parts:

(a) a stretchable multi-segment shaft having a top end and a bottom end;

(b) an upper fixed hub mounted axially on the top end of the shaft, the upper fixed hub being formed with a plurality of alignment slots and a threaded hole, the threaded hole allowing a finishing cap to be mounted thereon;

(c) a running hub slidably mounted on the shaft;

(d) a collapsible frame of a plurality of ribs including a set of upper ribs, a set of inner branch ribs, a set of middle branch rib, a set of linkage ribs, and a set of outer branch ribs, wherein each of the middle branch ribs is formed with a substantially U-shaped cross section to form a slot and integrally formed with a retaining piece;

(e) an assembly of a coil spring and an elastic piece provided on each pair of the inner branch ribs and the middle branch ribs to facilitate the self-opening mechanism of the collapsible umbrella, wherein the coil spring is mounted in the slot in each middle branch rib and retaining securely in position by the retaining piece, and the elastic piece has a first end linked to one of the inner branch ribs and a second end inserted in the coil spring; mounted in the slot in each middle branch rib; and (f) a fabric held on the collapsible frame.

In the foregoing collapsible umbrella, the upper fixed hub is formed with a threaded hole. In the case of the finishing cap being an outer-threaded type having a threaded bolt, the finishing cap is mounted on the upper fixed hub by directly screwing the threaded bolt thereof into the threaded hole in the upper fixed hub; and whereas in the case of the finishing cap being an inner-threaded type having a threaded hole, a threaded bolt is used to mounted the finishing cap on the upper fixed hub by screwing one end into the threaded hole in the upper fixed hub and the other end into the threaded hole in the finishing cap.

The collapsible frame includes a plurality of upper ribs linked to the upper fixed hub; a plurality of inner branch rib each having an inner end linked to the running hub and a middle portion linked to one of the upper ribs; a plurality of middle branch ribs each having an inner end linked to the outer end of one of the upper ribs; a plurality of linkage ribs each having an inner end linked to the outer end of the top rib and an outer end linked to the inner end of one of the middle branch ribs; a plurality of outer branch ribs each having an inner end linked to the outer end of one of the middle branch ribs; and an assembly of a dumbbell-like coil spring and an elastic piece which is a bent wire having one end (the bent portion) linked to the inner branch rib and the other end (the two tips) inserted in the coil spring. Further, the middle branch rib has a substantially U-shaped cross section formed with a slot which allows the coil spring to be inset therein. The middle branch rib is integrally formed with a retaining piece which is used to retain the coil spring securely in position in the slot for the purpose of preventing the coil spring from falling off position. The retaining piece is formed in such a manner as to urge forcibly against the constricted middle portion of the dumbbell-like coil spring so that the coil spring can be securely retained in position in the slot in the middle branch rib. The coil spring is stretched when the collapsible umbrella is collapsed which allows the collapsed umbrella to be thereafter expanded in a self-opening manner.

Moreover, the running hub is formed with a plurality of alignment slots for facilitating the collapse of the collapsible frame. The foregoing collapsible umbrella of the invention allows a more secured and reliable self-opening mechanism for the umbrella.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

First Preferred Embodiment

A first preferred embodiment of the collapsible umbrella according to the invention is illustratively depicted in the following with reference to FIGS. 1–11.

Figure 1:
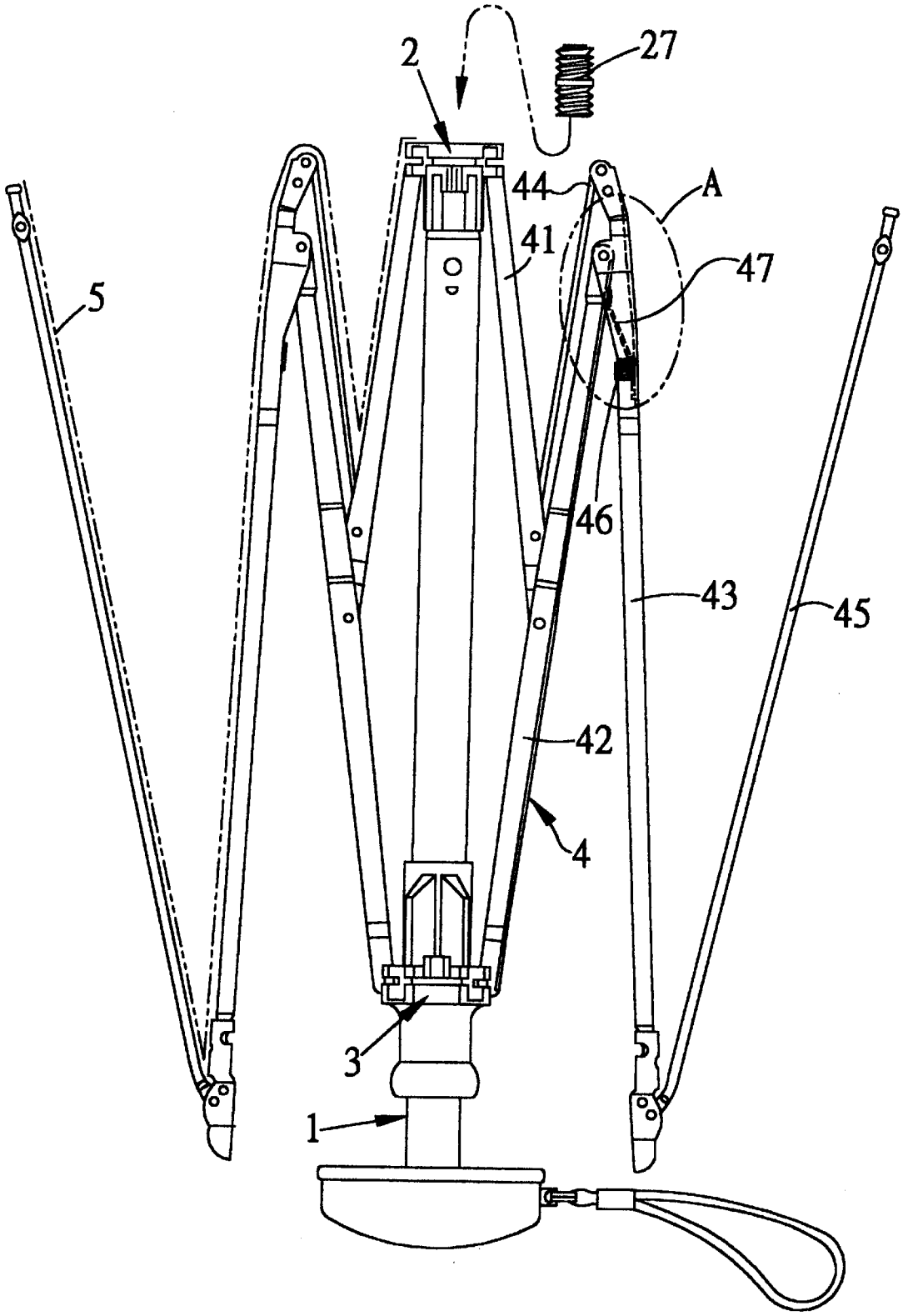
FIG. 1 is a schematic front view of a first preferred embodiment of the collapsible umbrella according to the invention.
Figure 3:
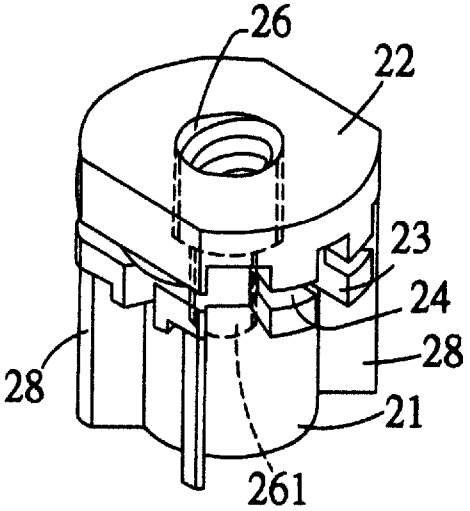
FIG. 3 is a schematic perspective view of the upper fixed hub utilized in the collapsible umbrella of FIG. 1.

As shown in FIG. 1, the collapsible umbrella includes a stretchable multi-segment shaft 1, an upper fixed hub 2 mounted on the top end of the shaft 1, a running hub (runner) 3 slidably and axially mounted on the shaft 1, a collapsible frame 4 consisting of a plurality of ribs radiating from the upper fixed hub 2 and the running hub 3, and a fabric 5 held on the collapsible frame 4.

Referring to FIGS. 3 through 7, the upper fixed hub 2 includes a base portion 21 and a top portion 22. The base portion 21 is used to mounting the upper fixed hub 2 on the top end of the shaft 1. The top portion 22 is formed with a plurality of slots 23 on the rim thereof for mounting the radiating ribs of the collapsible frame 4 therein, and a circular slot 24 for a wire (not shown) to join the radiating ribs together. A large threaded hole 26 and a small threaded hole 261 with a smaller diameter are formed in the top portion 22 for the mounting of an optional threaded bolt 27 (FIG. 1) therein. A plurality of longitudinally oriented alignment slots 28 are formed on the wall of the base portion 21 of the upper fixed hub 2.

The threaded hole 26 is used for the mounting of a finishing cap of the umbrella therein. In the case of the cap being all outer-threaded type having a threaded bolt, the finishing cap is mounted on the upper fixed hub by directly screwing the threaded bolt thereof into the threaded hole in the upper fixed hub 2; and whereas in the case of the finishing cap being an inner-threaded type having a threaded hole, the threaded bolt 27 is used to mounted the finishing cap on the upper fixed hub by screwing one end into the threaded hole in the upper fixed hub 2 and the other end into the threaded hole in the finishing cap.

Figure 4:
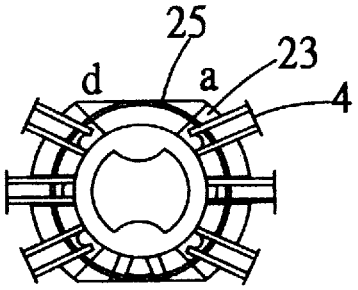
FIG. 4 is a schematic cross sectional view of the upper fixed hub and the ribs linked thereto when the collapsible frame of the collapsible umbrella is half collapsed.
Figure 5:
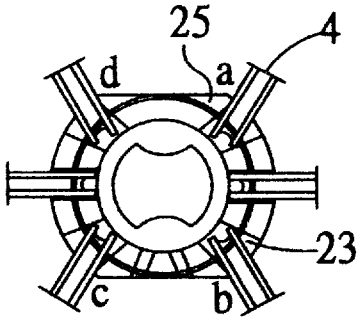
FIG. 5 shows the same of FIG. 4 when the collapsible frame of the collapsible umbrella is fully expanded.
Figure 6:
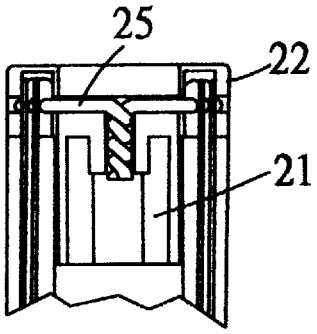
FIG. 6 is a schematic longitudinal sectional view of the upper fixed hub and the ribs linked thereto when the collapsible frame of the collapsible umbrella is fully collapsed.
Figure 7:
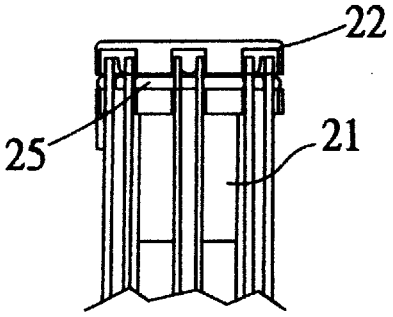
FIG. 7 shows the same of FIG. 6 when rotated by an angle of 90°.
Figure 8:
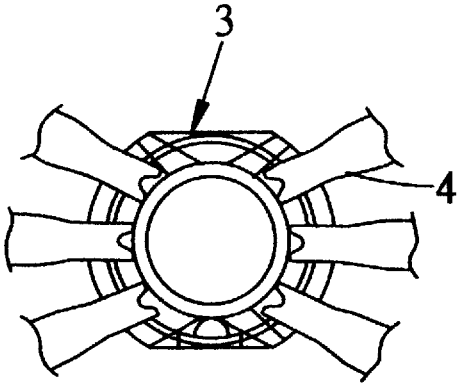
FIG. 8 is a schematic cross sectional view of the running hub and the ribs linked thereto when the collapsible frame of the collapsible umbrella is half collapsed.
Figure 9:
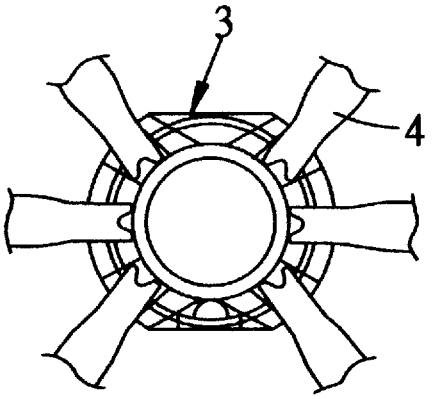
FIG. 9 shows the same of FIG. 8 when the collapsible frame of the collapsible umbrella is fully expanded.
Figure 10:
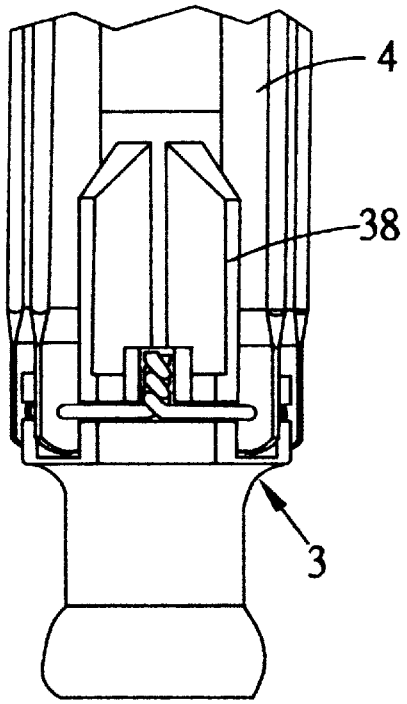
FIG. 10 is a schematic longitudinal sectional view of the running hub and the ribs linked thereto when the collapsible frame of the collapsible umbrella is collapsed.
Figure 11:
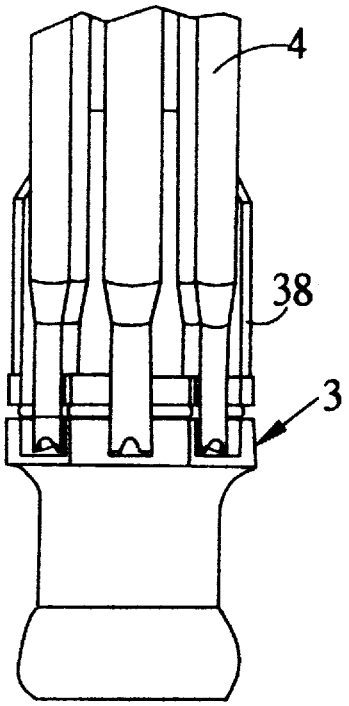
FIG. 11 shows the same of FIG. 10 when rotated by an angle of 90°.

As shown in FIG. 4, when the collapsible frame 4 is half expanded, those ribs of the collapsible frame 4 that are disposed at the four corners a, b, c, d are not abutted closely to the walls of the four corners a, b, c, d. However, as shown in FIG. 5, when the collapsible frame 4 is fully expanded, the same ribs will be abutted tightly on the walls of the four corners a, b, c, d, allowing these ribs to be stretched in a direction at an angle with respect to the radiating direction of the slots 23. Without the alignment slots 28, the ribs at the four corners a, b, c, d would be expanded out that makes the collapsible frame 4 to be not smoothly collapsed. With the help of the alignment slots 28, however, the ribs at the four corners a, b, c, d will be aligned by the alignment slots 28, thereby allowing the collapsible frame 4 to be smoothly collapsed, as illustrated in FIGS. 6 and 7.

The coupling between the running hub 3 and the collapsible frame 4 is illustrated in FIGS. 8 through 11. As shown, the running hub 3 is substantially identical in structure as the upper fixed hub 2 described above, except that the running hub 3 is not provided with a threaded mounting hole. The running hub 3 is also formed with a plurality of alignment slots 38 for the alignment of those ribs of the collapsible frame 4 that are connected to the running hub 3. The mechanism is substantially the same as the upper fixed hub 2 so detailed description thereof will not be repeated.

Figure 2:
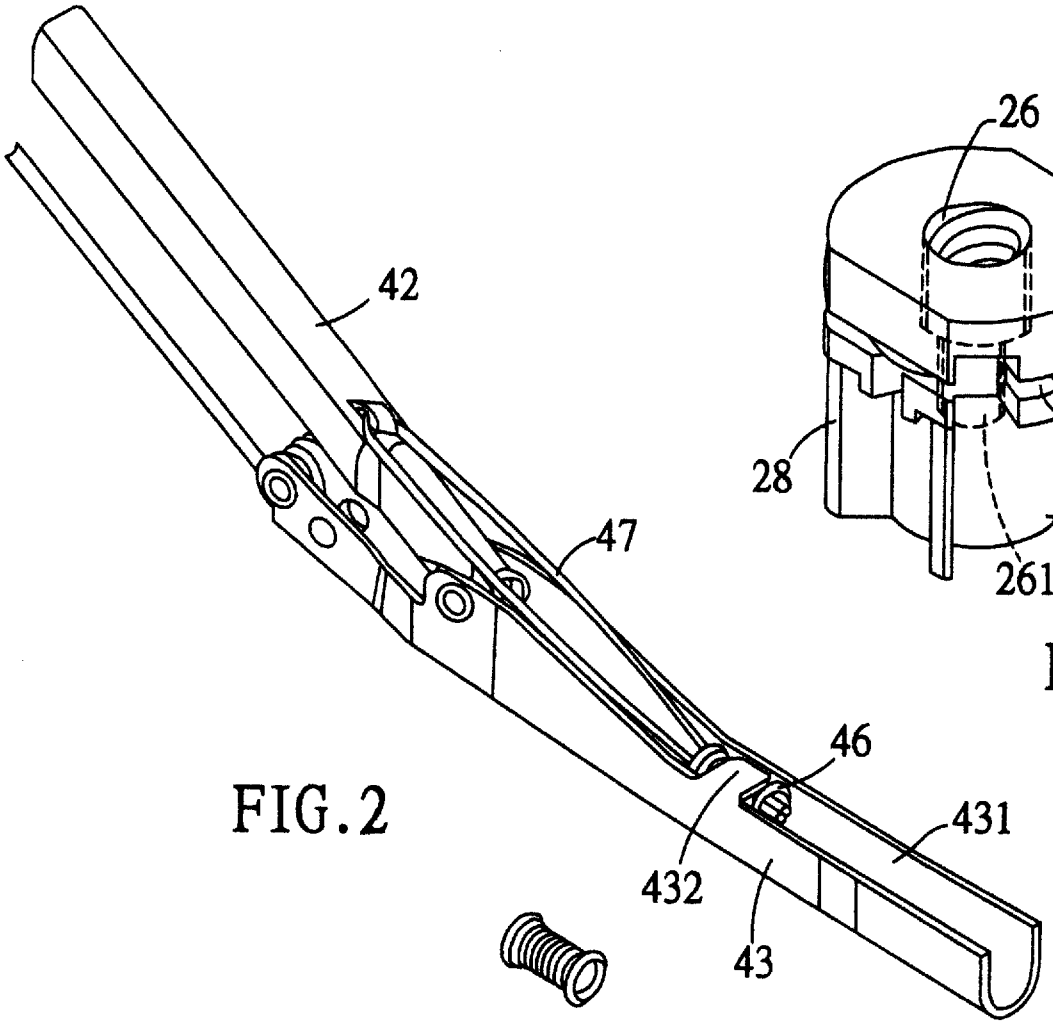
FIG. 2 is a schematic perspective diagram used to depict the method utilized by the collapsible umbrella of the invention to securely mount a coil spring in position on a middle branch rib of the collapsible frame.

Referring back to FIG. 1, the collapsible frame 4 includes a plurality of upper ribs 41 linked to the upper fixed hub 2, a plurality of inner branch rib 42 each having an inner end linked to the running hub 3 and a middle portion linked to one of the upper ribs 41; a plurality of middle branch ribs 43 each having an inner end linked to the outer end of one of the upper ribs 41; a plurality of linkage ribs 44 each having an inner end linked to the outer end of the top rib 41 and an outer end linked to the inner end of one of the middle branch ribs 43; a plurality of outer branch ribs 45 each having an inner end linked to the outer end of one of the middle branch ribs 43; and an assembly of a dumbbell-like coil spring 46 and an elastic piece 47 which is at bent wire having one end (the bent portion) linked to the inner branch rib 42 and the other end (the two tips) inserted in the coil spring 46. As shown in FIG. 2, the middle branch rib 43 has at substantially U-shaped cross section formed with a slot 431 which allows the coil spring 46 to be inset therein. The middle branch rib 43 is integrally formed with a retaining piece 432 which is used to retain the coil spring 46 securely in position in the slot 431 for the purpose of preventing the coil spring 46 from falling off position. The retaining piece 432 is formed in such a manner as to urge forcibly against the constricted middle portion of the dumbbell-like coil spring 46 so that the coil spring 46 can be securely retained in position in the slot 431 in the middle branch rib 43.

Second Preferred Embodiment

Figure 12:
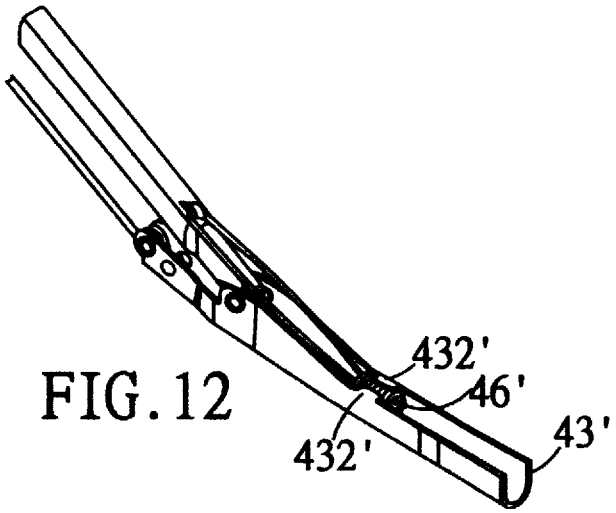
FIG. 12 is a schematic perspective view showing a different way of mounting the coil spring on one middle branch rib of the collapsible frame in the second preferred embodiment of the collapsible umbrella of the invention.

FIG. 12 is a schematic perspective view showing a different way of mounting the coil spring on one middle branch rib of the collapsible frame in the second preferred embodiment of the collapsible umbrella of the invention. In FIG. 12, the same elements as those in the previous embodiment are designated by the same reference numerals but appended with an apostrophe '.

This embodiment differ from the previous one in that the middle branch rib 43' here is integrally formed with a pair of retaining pieces 432' on both sides of the coil spring 46'. The two retaining piece 432' thus can provide an even more secured effect to the coil spring 46'.

Third Preferred Embodiment

Figure 13:
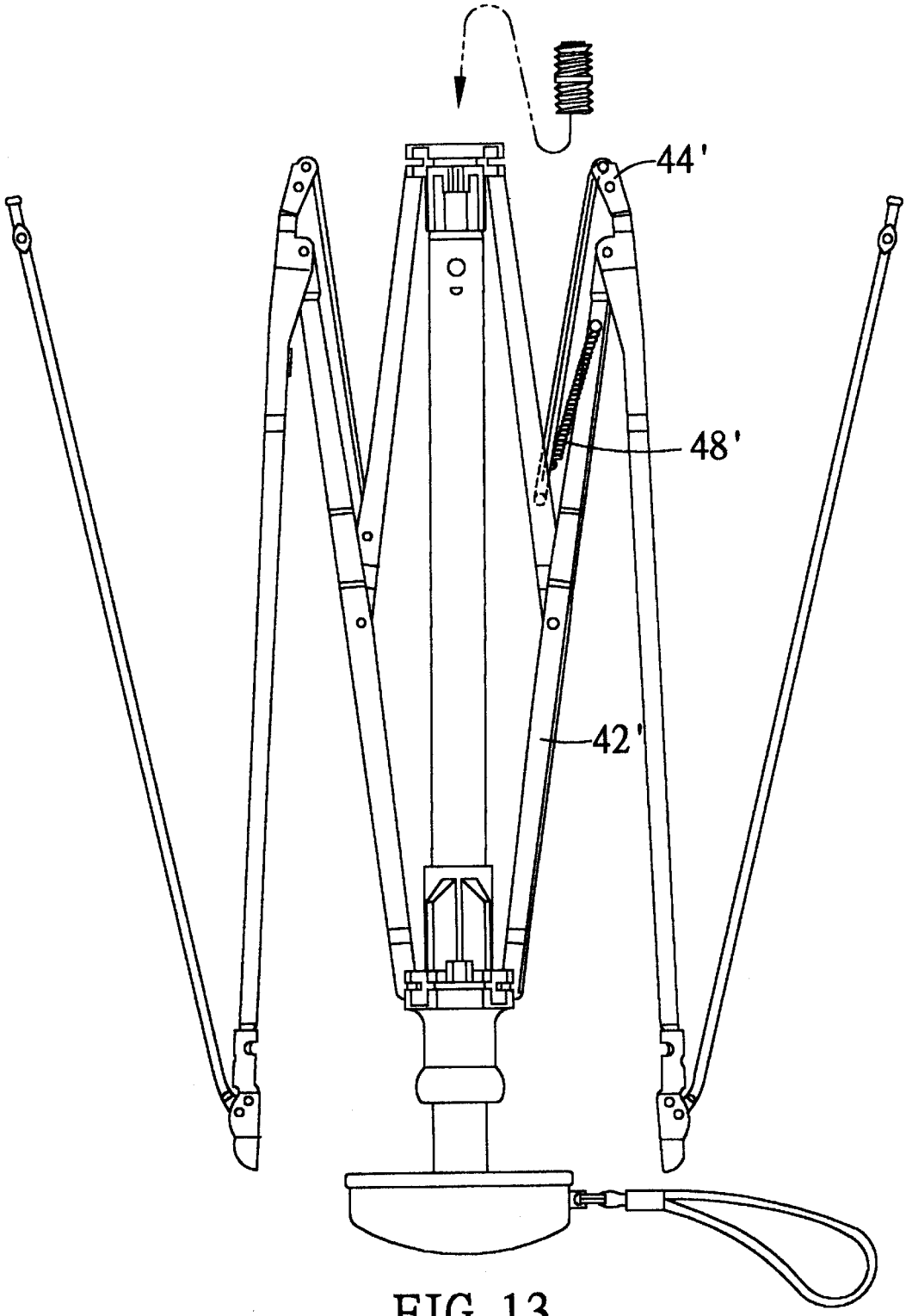
FIG. 13 is a schematic front view of a third preferred embodiment of the collapsible umbrella according to the invention.

FIG. 13 is a schematic front view of a third preferred embodiment of the collapsible umbrella according to the invention. This embodiment differs from the first embodiment only in that the retaining piece 432, the coil spring 46, and the elastic piece 47 in the first embodiment are here replaced by an elongated coil spring 48" which has an inner end linked to the linkage rib 44" and an outer end linked to the inner branch rib 42". This provision also helps the collapsible frame to be collapsed smoothly.

Fourth Preferred Embodiment

Figure 14:
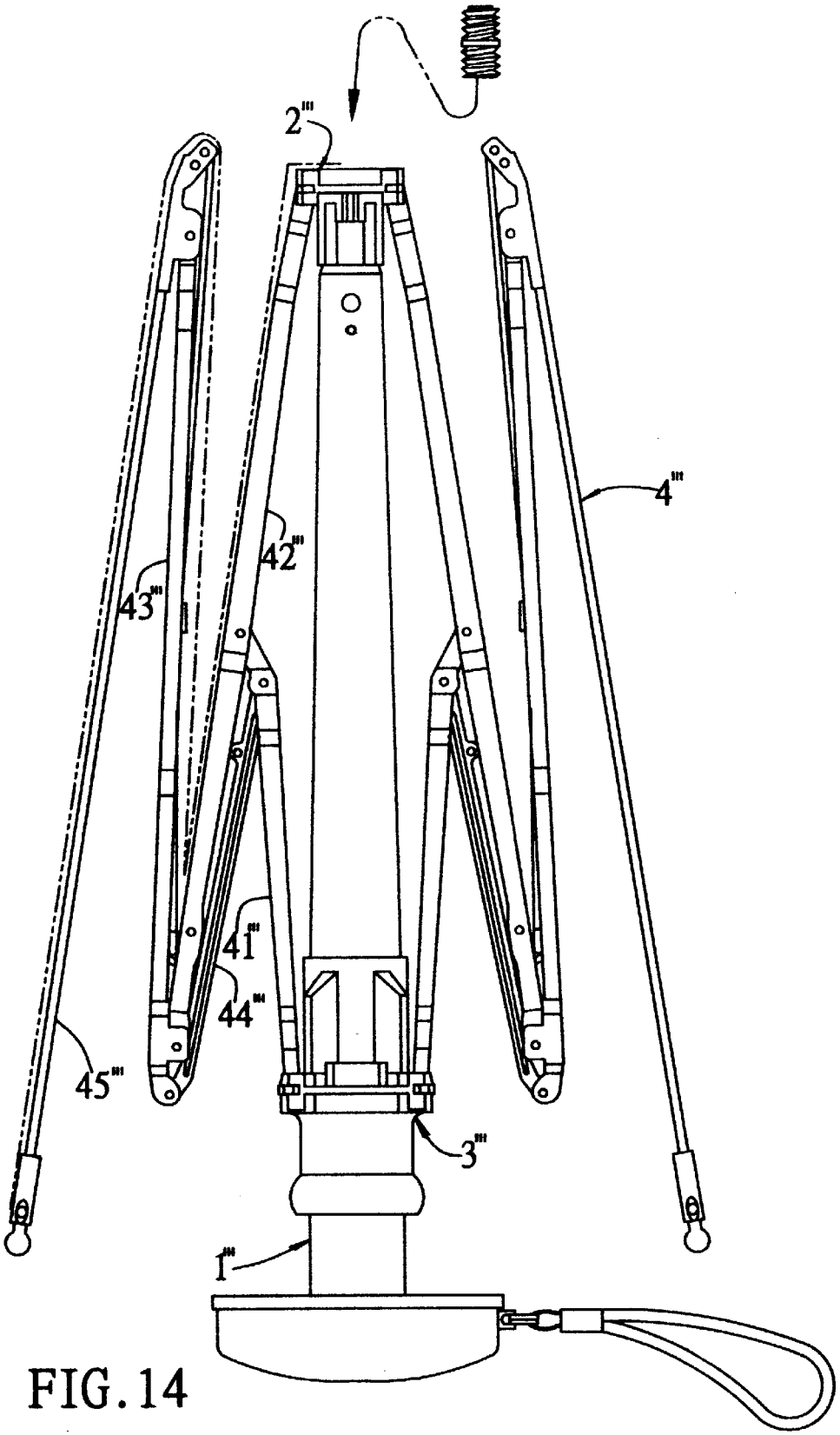
FIG. 14 is a schematic front view of a fourth preferred embodiment of the collapsible umbrella according to the invention.
Figure 15:
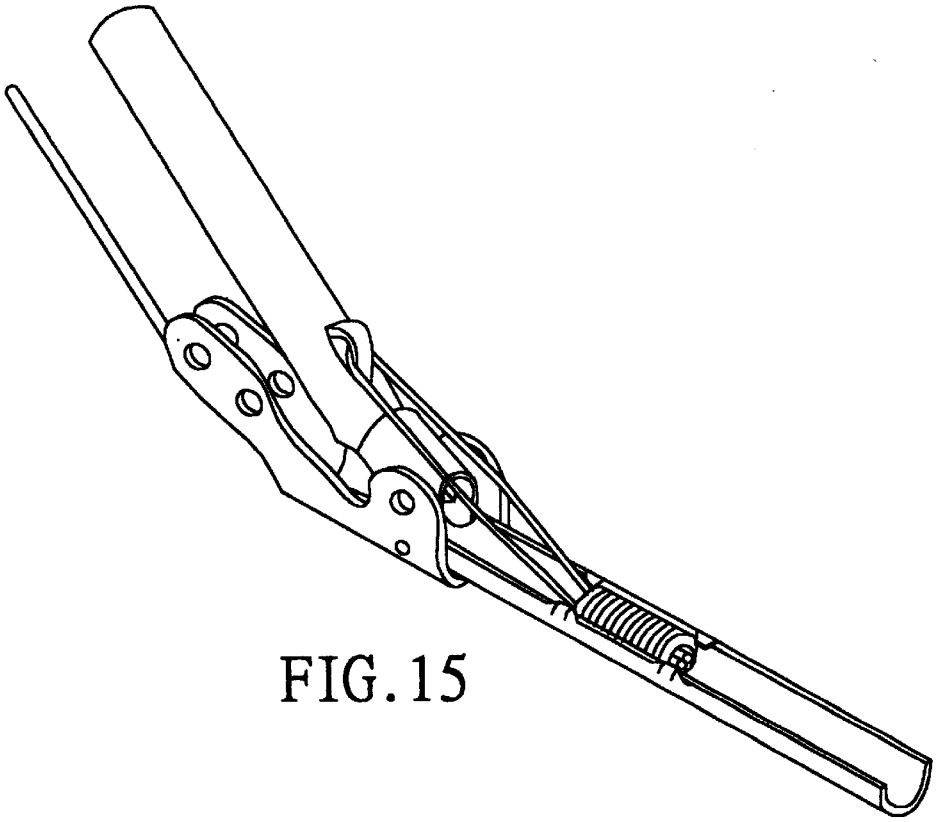
FIG. 15 (prior art) is a schematic perspective view showing a conventional method of mounting an elastic piece and a coil spring on one rib of the collapsible frame of the collapsible umbrella.
Figure 16:
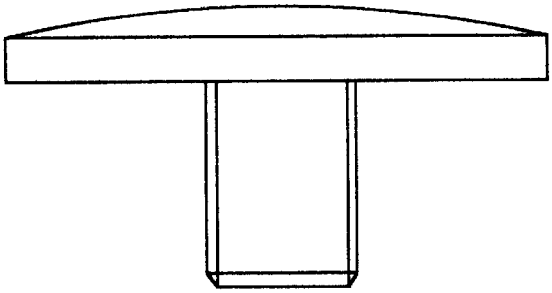
FIG. 16 (prior art) is a schematic diagram of a conventional external screw type of the tail part of an umbrella.
Figure 17:
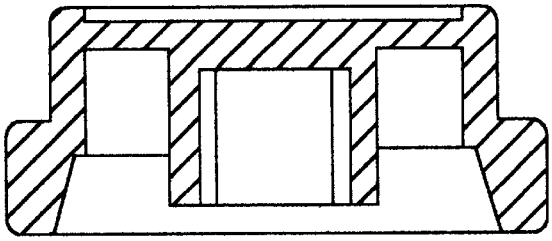
FIG. 17 (prior art) is a schematic diagram of a conventional internal screw type of the tail part of an umbrella when mounted on the upper fixed hub.

FIG. 14 is a schematic front view of a fourth preferred embodiment of the collapsible umbrella according to the invention. This embodiment differs from the previous ones in that the inner end of the upper rib 41''' of the collapsible frame 4''' is linked to the running hub 3'''. The middle branch rib 43''', the linkage rib 44''', and the outer branch rib 45''' are interlinked in the same manner as the first preferred embodiment, but differ in that the inner and outer ends of the ribs of the collapsible frame 4''' are inverted in position when the umbrella is in collapsed state. For instance, the outer branch rib 45 in the first preferred embodiment has its outer end facing the bottom end of the shaft 1 (see FIG. 1); in this embodiment, however, the outer branch rib 45''' has its outer end facing the top end of the shaft 1'''.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A collapsible umbrella, which comprises:

a stretchable multi-segment shaft having a top end and a bottom end;

an upper fixed hub mounted axially on the top end of said shaft, said upper fixed hub being formed with a plurality of alignment slots and a threaded hole, said threaded hole allowing a finishing cap to be mounted thereon;

a running hub slidably mounted on said shaft;

a collapsible frame of a plurality of ribs including a set of upper ribs, a set of inner branch ribs, a set of middle branch rib, a set of linkage ribs, and a set of outer branch ribs, wherein each of said middle branch ribs is formed with a substantially U-shaped cross section to form a slot and integrally formed with a retaining piece;

an assembly of a coil spring and an elastic piece provided on each pair of said inner branch ribs and said middle branch ribs to facilitate the self-opening mechanism of the collapsible umbrella, wherein said coil spring is mounted in the slot in each middle branch rib and retaining securely in position by said retaining piece, and said elastic piece has a first end linked to one of said inner branch ribs and a second end inserted in the coil spring; mounted in the slot in each middle branch rib; and a fabric held on said collapsible frame.

2. The collapsible umbrella of claim 1, wherein said running hub is formed with a plurality of alignment slots for facilitating the collapsing of said collapsible frame.

3. The collapsible umbrella of claim 1, wherein said coil spring is formed in a dumbbell-like shape.

4. The collapsible umbrella of claim 1, wherein said finishing cap being an outer-threaded type having a threaded bolt, said finishing cap is mounted on said upper fixed hub by directly screwing the threaded bolt thereof into the threaded hole in said upper fixed hub.

5. The collapsible umbrella of claim 1, wherein said finishing cap being an inner-threaded type having a threaded hole, a threaded bolt is used to mount said finishing cap on said upper fixed hub by screwing one end into the threaded hole in said upper fixed hub and the other end into the threaded hole in said finishing cap.

* * * * *